US007325587B2

(12) United States Patent
Memmen

(10) Patent No.: US 7,325,587 B2
(45) Date of Patent: Feb. 5, 2008

(54) METHOD FOR CASTING COOLING HOLES

(75) Inventor: Robert L. Memmen, Cheshire, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/216,278

(22) Filed: Aug. 30, 2005

(65) Prior Publication Data

US 2007/0044935 A1 Mar. 1, 2007

(51) Int. Cl.
*B22C 7/00* (2006.01)
*B22C 9/00* (2006.01)

(52) U.S. Cl. ..... 164/516; 164/45; 164/361

(58) Field of Classification Search ..... 164/516, 164/369, 361, 137, 45
See application file for complete search history.

(56) References Cited

U.S. PATENT DOCUMENTS

| | | | | |
|---|---|---|---|---|
| 3,305,358 | A * | 2/1967 | Lirones | 419/38 |
| 3,537,949 | A * | 11/1970 | Brown et al. | 428/472 |
| 3,662,816 | A * | 5/1972 | Bishop et al. | 164/366 |
| 5,140,869 | A * | 8/1992 | Mrdjenovich et al. | 74/579 E |
| 5,317,805 | A * | 6/1994 | Hoopman et al. | 29/890.03 |
| 6,255,000 | B1 * | 7/2001 | O'Connor et al. | 428/586 |
| 6,626,230 | B1 * | 9/2003 | Woodrum et al. | 164/516 |
| 7,032,647 | B2 * | 4/2006 | Gegel et al. | 164/516 |

* cited by examiner

*Primary Examiner*—Kevin P. Kerns
(74) *Attorney, Agent, or Firm*—Bachman & LaPointe, P.C.

(57) ABSTRACT

A method for casting a cooled component includes molding a sacrificial pattern. A plurality of holes are formed through the pattern. A shell is formed over the pattern including filling the holes. The pattern is destructively removed from the shell. A metallic material is cast in the shell. The shell is destructively removed.

17 Claims, 5 Drawing Sheets

METHOD FOR CASTING COOLING HOLES

The invention relates to turbine engines. More particularly, the invention relates to casting of cooled thin-wall components of gas turbine engines.

Gas turbine engine combustor components such as heat shield and floatwall panels are commonly made of polycrystalline alloys. These components are exposed to extreme heat and thermal gradients during various phases of engine operation. Thermal-mechanical stresses and resulting fatigue contribute to component failure. Significant efforts are made to cool such components to provide durability. For example, to provide cooling of heat shield panels, the panels often include arrays of film cooling holes at angles off-normal to the surface facing the combustor interior. A low (shallow) angle through the panel (large off-normal angle) wall increases the surface area exposed to the air passing through the holes and, thereby, increases convective cooling. A low discharge angle provides the film cooling as the flow passes along the surface. Such cooling holes may be drilled in the cast panel (e.g., by laser drilling).

SUMMARY OF THE INVENTION

One aspect of the invention involves a method for casting including molding a sacrificial pattern. After the molding, a plurality of holes are formed through the pattern. A shell is formed over the pattern including filling the holes. The pattern is destructively removed from the shell. A metallic material is cast in the shell. The shell is destructively removed.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
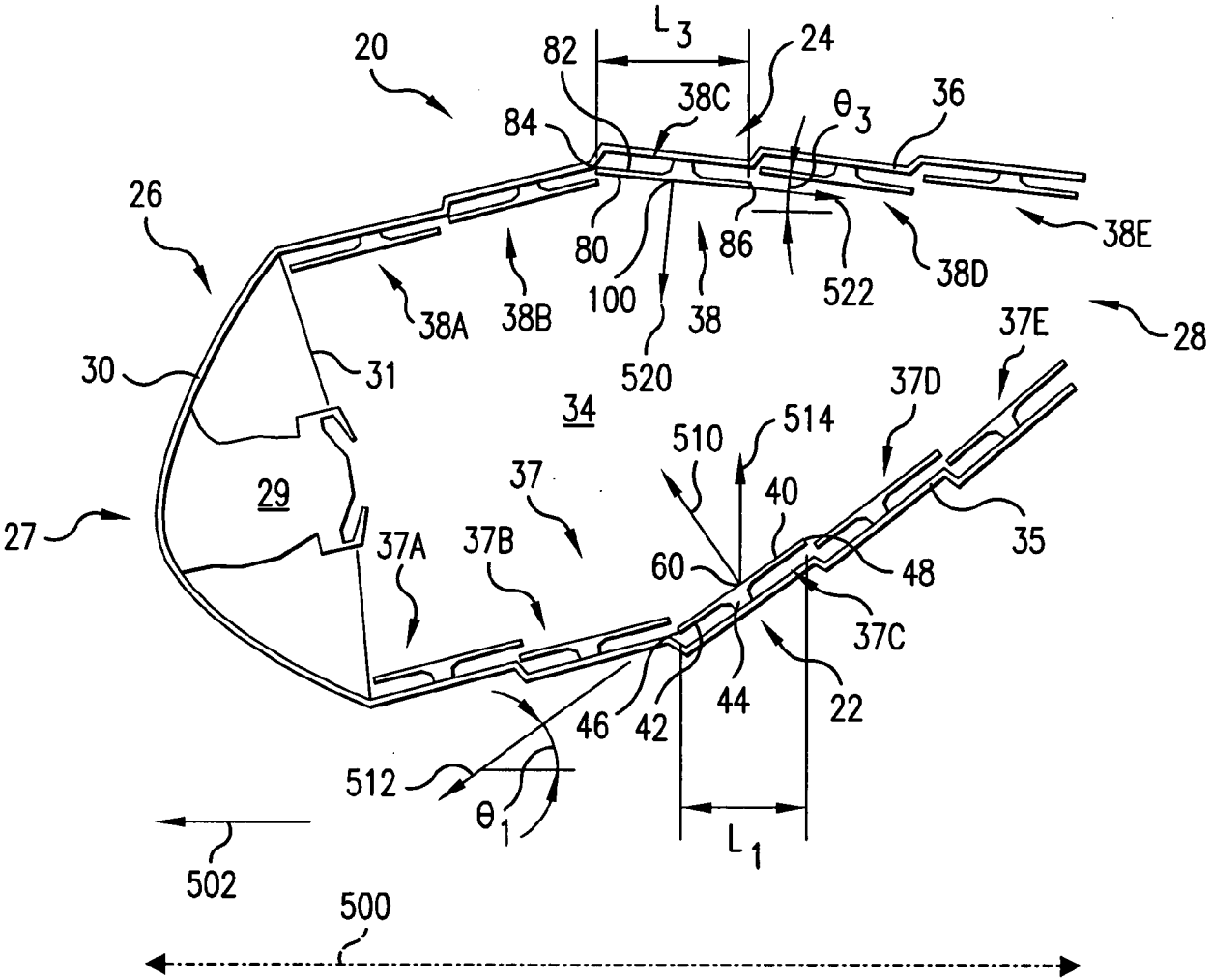
FIG. 1 is a longitudinal sectional view of a gas turbine engine combustor.

FIG. 1 shows a gas turbine engine combustor 20. The exemplary combustor 20 is generally annular about an engine central longitudinal axis (centerline) 500 parallel to which a forward direction 502 is illustrated. The exemplary combustor has two-layered inboard and outboard walls 22 and 24. The walls 22 and 24 extend aft/downstream from a bulkhead 26 at an upstream inlet 27 receiving air from the compressor section (not shown) to a downstream outlet 28 delivering air to the turbine section (not shown). A circumferential array of fuel injector/swirler assemblies 29 may be mounted in the bulkhead.

Figure 2:
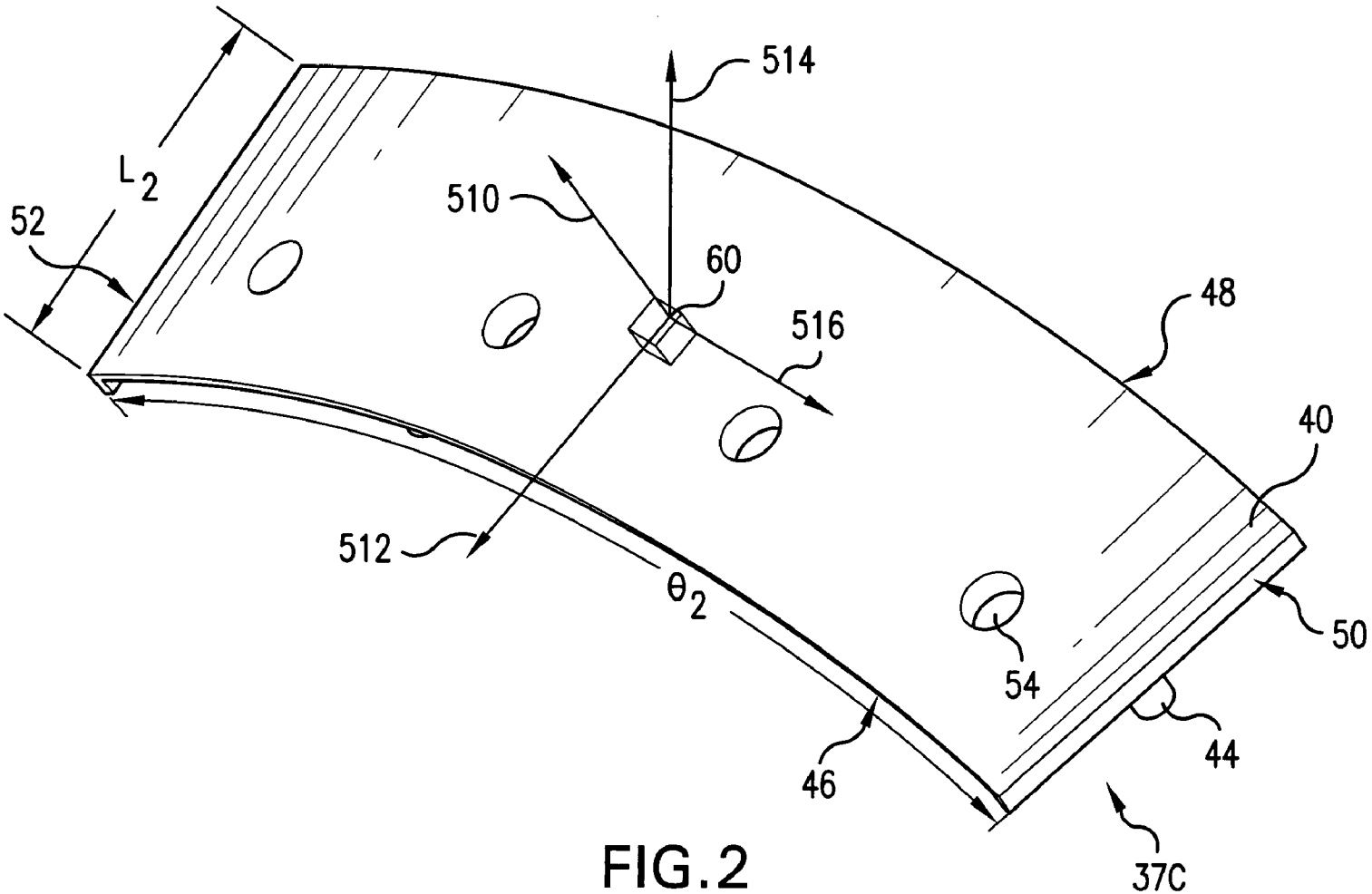
FIG. 2 is a view of an inboard heat shield panel of the combustor of FIG. 1.

The bulkhead includes a shell portion 30 and a heat shield 31 spaced aft/downstream thereof. The heat shield 31 may be formed by a circumferential array of bulkhead panels, at least some of which have apertures for accommodating associated ones of the injector/swirler assemblies. The combustor has an interior 34 aft/downstream of the bulkhead panel array. The inboard and outboard walls 22 and 24 respectively have an outboard shell 35 and 36 and an inner heat shield 37 and 38. The shells may be contiguous with the bulkhead shell. Each exemplary wall heat shield is made of a longitudinal and circumferential array of panels as may be the shells. In exemplary combustors there are two to six longitudinal rings of six to twenty heat shield panels. From upstream to downstream, respective panels of the shields 37 and 38 are identified as 37A-E and 38A-E. With reference to the exemplary panel 37C, each panel has a generally inner (facing the interior 34) surface 40 and a generally outer surface 42. Mounting studs 44 or other features may extend from the other surface 42 to secure the panel to the adjacent shell. The panel extends between a leading edge 46 and a trailing edge 48 and between first and second lateral (circumferential) edges 50 and 52 (FIG. 2). The panel may have one or more arrays of process air cooling holes 54 between the inner and outer surfaces and may have additional surface enhancements (not shown) on one or both of such surfaces as is known in the art or may be further developed.

The inner surface 40 is circumferentially convex and has a center 60. FIG. 1 further shows a surface normal 510 and a conewise direction 512 normal thereto. The exemplary panel has a conical half angle $\theta_1$, a longitudinal span $L_1$, and a conewise span $L_2$ (FIG. 2). A radial direction is shown as 514. A circumferential direction is shown as 516. An angle spanned by the panel between the lateral edges about the engine centerline is shown as $\theta_2$. With an exemplary eight panels per ring, $\theta_2$ is nominally 45° (e.g., slightly smaller to provide gaps between panels).

Figure 3:
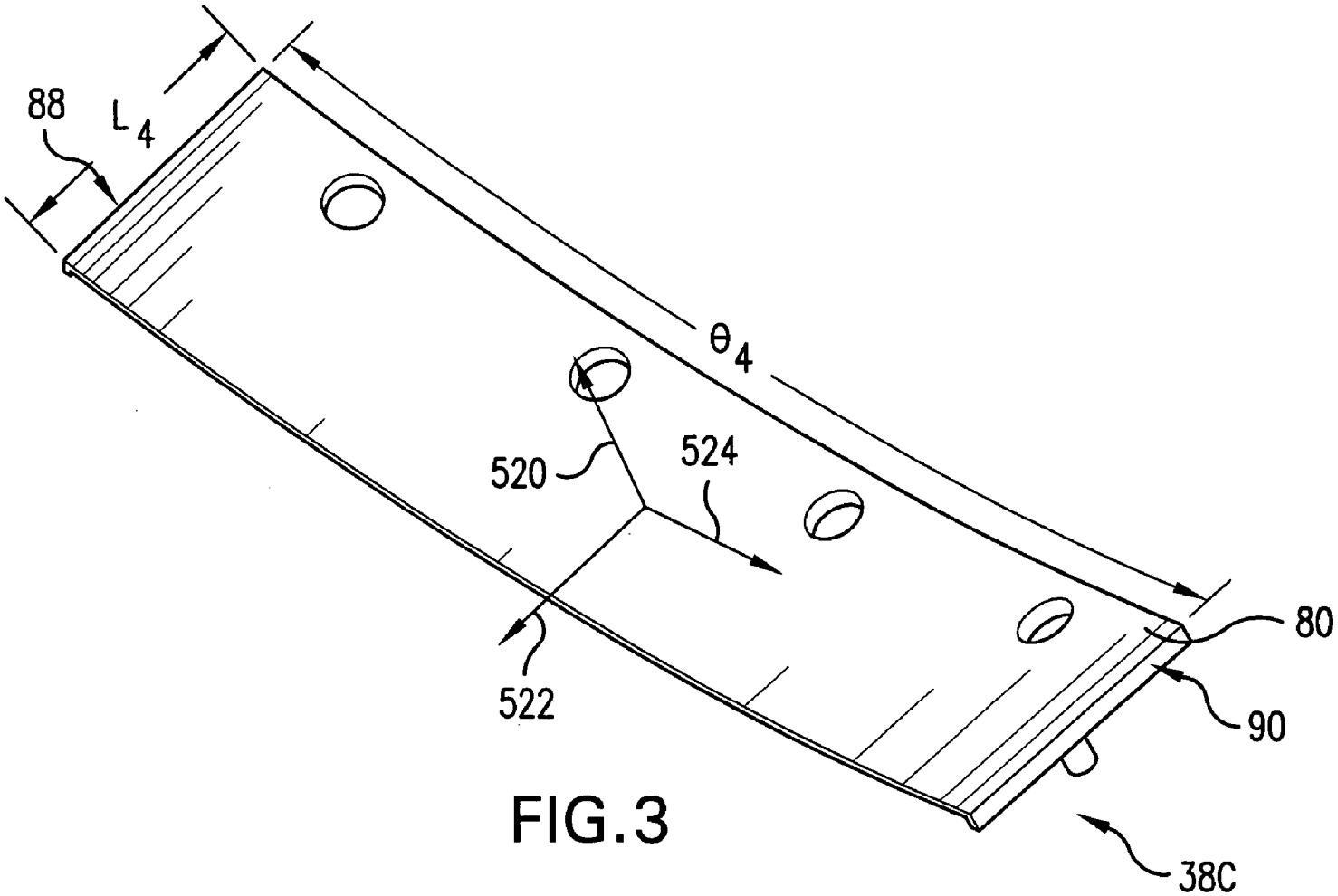
FIG. 3 is a view of an outboard heat shield panel of the combustor of FIG. 1.

Similarly, the exemplary panel 38C has inner and outer surfaces 80 and 82, leading and trailing edges 84 and 86, and lateral edges 88 and 90 (FIG. 3). The inner surface 80 is circumferentially concave and has a center 100. A surface normal is shown as 520 and a conewise direction shown as 522. The conical half angle is shown as $-\theta_3$ (for reference, a negative angle will be associated with a rearwardly convergent cone) and the longitudinal span is shown as $L_3$. A circumferential direction is shown as 524 in FIG. 3. A circumferential span is shown as $\theta_4$ and the conewise span is shown as $L_4$.

Figure 4:
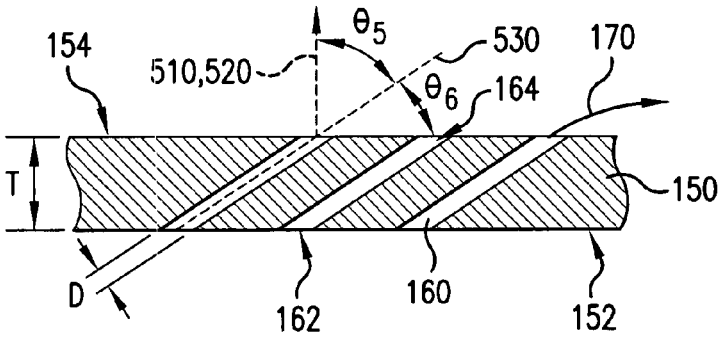
FIG. 4 is a cross-sectional view of film cooling holes in one of the heat shield panels of FIGS. 2 and 3.

FIG. 4 shows a main body wall portion 150 of an exemplary one of the panels (e.g., of the shields 37 and 38 or the bulkhead shield 31). The main portion has a local thickness T between an outboard surface portion 152 and the adjacent inboard surface portion 154 (e.g., of the surfaces 40 or 80). An array of film cooling holes or channels 160 extend between inlets 162 in the surface 152 and outlets 164 in the surface 154. The exemplary holes 160 are straight, having central longitudinal axes 530. Exemplary holes 160 have circular cross-sections normal to the axis 530 and having a diameter D. The holes 160 extend off-normal to the local inboard surface portion 154 by an angle $\theta_5$, thus being off the surface portion 154 by $\theta_6$, the complement of $\theta_5$. The holes 160 may be grouped in regular or irregular arrays and may be distributed to provide a desired cooling profile. Exemplary $\theta_5$ are in excess of 45° (e.g., 50-70°) so that discharged air flows 170 provide a film cooling effect.

Figure 5:
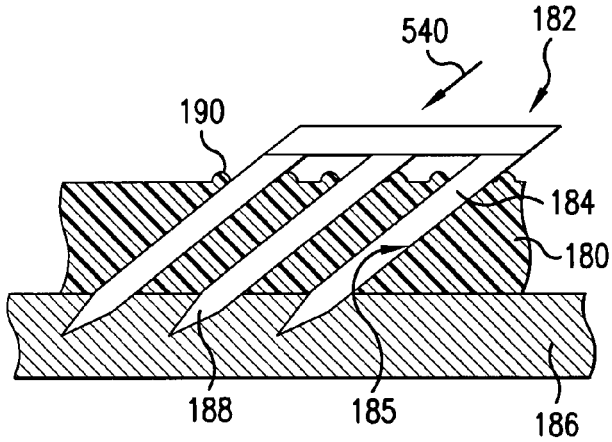
FIG. 5 is a sectional view of a pattern along with an apparatus for forming the film cooling holes.

FIG. 5 shows a molded wax pattern 180 having the overall form of the heat shield panel but molded without the cooling holes. For example, the pattern may be molded with portions corresponding to the panel main body, the process air cooling holes, perimeter and internal outboard reinforcement rails, and the like. After molding, features corresponding to the film cooling holes 160 may then be formed. FIG. 5 specifically shows a heated array 182 of probes 184 inserted into the pattern in a direction 540 (parallel to the ultimate axes 530) to form holes 185 corresponding to the cooling holes 160. To maintain pattern integrity, a backing element 186 may be placed along one of the faces of the pattern. The backing element 186 may be pre-formed with apertures for receiving tip portions 188 of the probes as they pass through the pattern. Alternatively, the backing element 186 may be deformable to accommodate the tip portions. After insertion, the probe array may be retracted in the opposite direction. The probe array may displace material to create the holes 185. This may leave elevations 190 at one or both faces. The elevations 190 may be trimmed. Alternatively, the probes may be hollow and may evacuate the displaced material.

There may be multiple groups of the holes 185. As noted above, the holes of the individual groups may have parallel axes. The holes of the different groups may have axes parallel to the axes of the holes of the other groups or not parallel thereto. For example, non-parallel axes may be appropriate to achieve desired flow patterns in the ultimate cast panel. Other drilling techniques for forming the holes 185 may be used including mechanical twist drilling. The holes 185 may be formed individually or simultaneously in groups as noted above.

Figure 6:
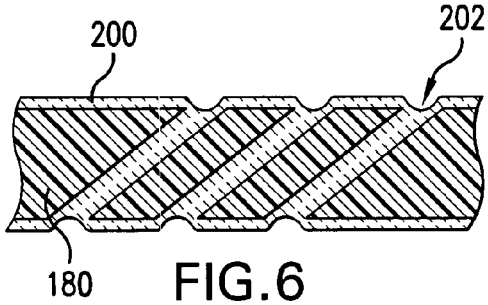
FIG. 6 is a cross-sectional view of the pattern of FIG. 5 after a first shelling stage.

After the holes 185 are formed in the pattern, the pattern may be shelled in a multi-stage stuccoing process. FIG. 6 shows the pattern 180 after a first slurry dip in the shelling process. The initial dip is typically in a thin and fine slurry to provide a smooth final interior surface for the ultimate shell. FIG. 6 shows a layer 200 of this slurry on both faces of the pattern main body and substantially filling the holes 185 (e.g., due to surface tension, having slight recesses 202 at the ends of the holes). Further shelling steps may involve thicker and coarser slurries. After the final shelling step, the shell may be permitted to dry. The wax may be removed such as by a steam autoclave and/or shell firing (to harden the shell).

Figure 7:
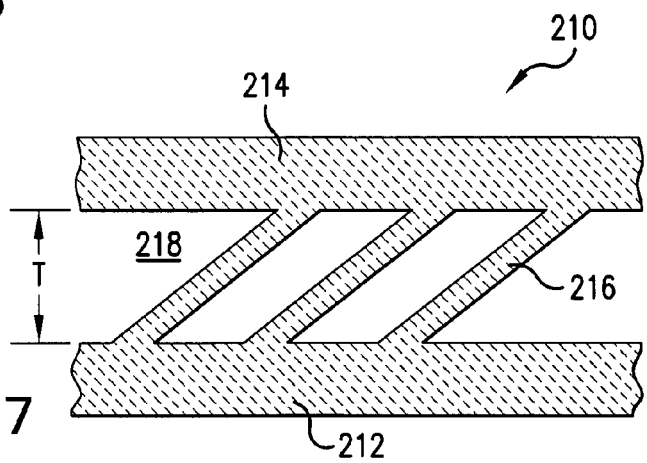
FIG. 7 is a sectional view of a shell formed using the pattern of FIG. 6.

FIG. 7 shows the shell 210 after wax removal. The shell has first and second sidewalls 212 and 214. Shell features 216, formed in the pattern holes 185 connect the sidewalls 212 and 214 by spanning the shell interior 218. Upon introduction of cast metal to the shell interior 218, the spanning features 216 form and define the film cooling holes 160. After the pouring and metal solidification, the shell may be destructively removed (by mechanical and/or chemical means). An exemplary removal involves mechanically breaking away the sidewalls 212 and 214 and then chemically (e.g., by an acid or alkaline leaching) removing the spanning features 216.

Figure 8:
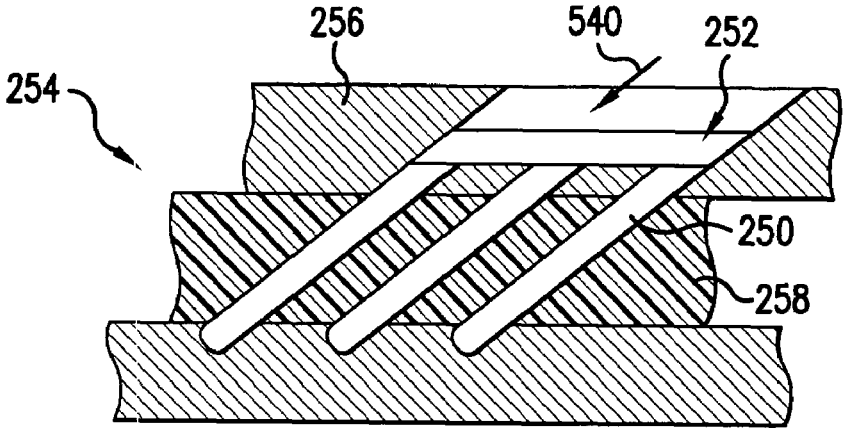
FIG. 8 is a sectional view of a pattern in a pattern forming die including an inserted probe array.
Figure 9:
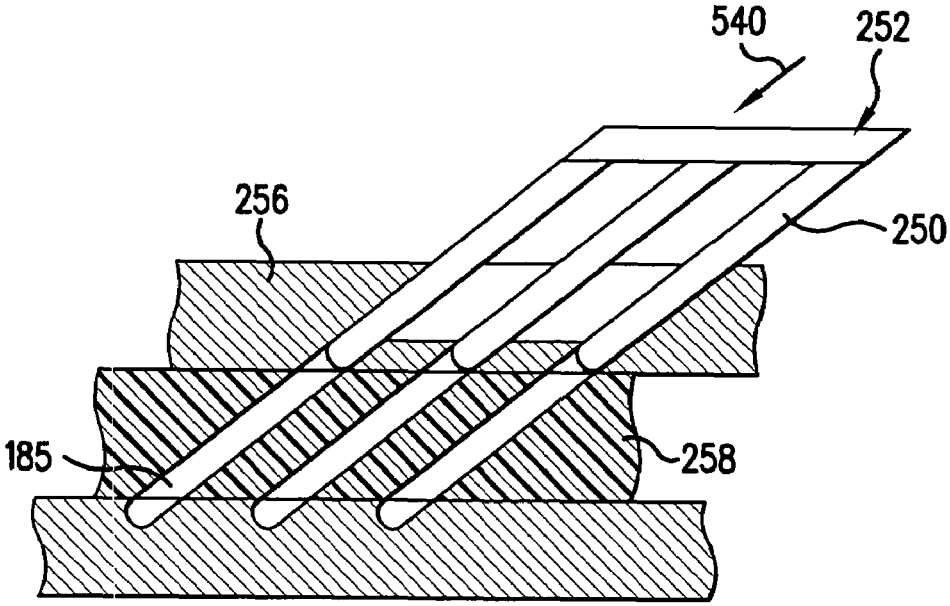
FIG. 9 is a sectional view of the pattern of FIG. 8 with the probe array retracted.

An alternative method of manufacture pre-forms the holes in the pattern as the wax material is molded. An array of probes or tines 250 (FIG. 8—similarly arranged to the array 182) may be formed on a slider element 252 of the pattern molding die 254. The slider 252 is inserted into one of the main elements 256 of the die during die assembly and the wax 258 is molded around the slider probes 250. After wax cooling/hardening, the slider is then retracted (FIG. 9) to disengage the probes 250 from the pattern, leaving the holes 160 and releasing a backlocking of the pattern relative to the main element 256.

The present methods may have one or more of several advantageous properties and uses. Mechanical drilling of cooling holes in a casting is increasingly difficult as the off-normal angle increases. Thus, casting may be particularly useful for providing film cooling holes. Additionally, the spanning features 216 may tend to maintain the relative positions of the sidewalls 212 and 214 during casting. This may provide improved consistency of the thickness T among castings and uniformity of the thickness T within given castings. With such improved uniformity, the practicability of making a relatively thin casting is improved.

For a combustor heat shield, an exemplary thickness T is advantageously less than 0.08 inch (2.0 mm). More broadly, the thickness may be less than 0.12 inch (3.0 mm) or 0.10 inch (2.5 mm). In an exemplary reengineering or remanufacturing situation, the panel is engineered or manufactured as a drop-in replacement for an existing panel having drilled film cooling holes. In this reengineering/remanufacturing situation, the final thickness T may be approximately 0.06 inch (1.5 mm) compared with a baseline thickness in excess of 0.08 inch (2.0 mm). For an exemplary panel thickness in the 0.06-0.08 inch (1.5-2.0 mm) range, an exemplary diameter D is less than about 0.032 inch (0.81 mm). Although particularly fine passageways maybe more desirable, shell integrity issues may mitigate in favor of a diameter 0.018-0.030 inch (0.46-0.76 mm) range. More broadly, this diameter is advantageously less than the thickness and, more advantageously less than half the thickness. For non-circular sectioned holes, hole cross-sectional areas may be compared with the areas corresponding to these diameters. For the 0.46-0.81 mm diameter range corresponding areas are 0.16-0.52 $mm^2$. A narrower range would be 0.20-0.46 $mm^2$.

One or more embodiments of the present invention have been described. Nevertheless, it will be understood that various modifications may be made without departing from the spirit and scope of the invention. For example, the principles may be applied to manufacture of exhaust nozzle liners and other thin wall cast structures. Where applied as a reengineering of an existing component, details of the existing component may influence or dictate details of any particular implementation. Accordingly, other embodiments are within the scope of the following claims.

What is claimed is:

1. A method for casting comprising:

molding a sacrificial pattern;

after said molding, forming a plurality of holes through the pattern, the holes oriented at an off-normal angle of 30-70°;

forming a shell over the pattern including filling the holes;

destructively removing the pattern from the shell;

casting a metallic material in the shell; and destructively removing the shell from the metallic material.

2. The method of claim 1 wherein:

the shelling comprises a multi-stage stuccoing; and a first dip stage of said stuccoing essentially fills the holes.

3. The method of claim 1 wherein:

the forming of the plurality of holes consists essentially of mechanical drilling.

4. The method of claim 1 wherein:

the forming of the plurality of holes consists essentially of inserting at least one hot probe.

5. The method of claim 1 wherein:

the forming of the plurality of holes consists essentially of inserting at least one hot probe at an off-normal angle of 30-70°.

6. The method of claim 1 wherein:

the forming of the plurality of holes consists essentially of inserting a plurality of hot probes as a unit.

7. The method of claim 1 wherein:

the plurality of holes are formed with cross-sectional average transverse dimensions of less than half a local thickness.

8. The method of claim 1 wherein:

the plurality of holes are formed with cross-sectional areas of less than 0.52 $mm^2$.

9. The method of claim 1 wherein:

the plurality of holes are formed with cross-sectional areas of 0.20-0.46 $mm^2$.

10. The method of claim 1 wherein:

the plurality of holes are formed with cross-sectional areas of 0.16-0.52 $mm^2$.

11. The method of claim 1 used to manufacture a gas turbine engine combustor panel.

12. A method for forming a cooled gas turbine engine component comprising:

forming a sacrificial pattern having a plurality of holes;

forming a shell over the pattern including filling the holes;

destructively removing the pattern from the shell;

casting a metallic material in the shell; and destructively removing the shell from the metallic material, the material forming the gas turbine engine component having film cooling holes left by portions of the shell that had filled the holes.

13. The method of claim 12 wherein:

a local thickness of the pattern at said holes is less than 3.0 mm;

the holes have cross-sectional areas of less than 0.52 $mm^2$; and the holes are at an angle off-normal to a local surface of the pattern by 30-70°.

14. The method of claim 12 wherein the forming of the sacrificial pattern comprises:

assembling a die including a plurality of main elements and a plurality of pins;

injecting a wax material into the die over the pins;

extracting the plurality of pins at least partially through at least one of the main elements; and removing the pattern from the main elements.

15. The method of claim 14 wherein:

the plurality of pins are extracted as a unit.

16. A method for casting comprising:

molding a sacrificial pattern;

forming a plurality of holes through the pattern, the forming comprising extracting a plurality of hole forming elements as a unit;

forming a shell over the pattern including filling the holes;

destructively removing the pattern from the shell;

casting a metallic material in the shell; and destructively removing the shell from the metallic material.

17. The method of claim 16 wherein said extracting is at an angle off-normal to a local surface of the pattern by 30-70°.

* * * * *